US005639255A

United States Patent [19]

Muzslay

[11] Patent Number: 5,639,255

[45] Date of Patent: Jun. 17, 1997

[54] CONNECTOR LATCH MECHANISM

[75] Inventor: Steven Zoltan Muzslay, Huntington Beach, Calif.

[73] Assignee: ITT Corporation, New York, N.Y.

[21] Appl. No.: 489,334

[22] Filed: Jun. 12, 1995

Related U.S. Application Data

[62] Division of Ser. No. 300,685, Sep. 2, 1994, Pat. No. 5,460,549.

[51] Int. Cl.[6] ..... H01R 13/62

[52] U.S. Cl. ..... 439/347

[58] Field of Search ..... 439/349, 347; 285/305

[56] References Cited

U.S. PATENT DOCUMENTS

| | | | |
|---|---|---|---|
| 2,619,515 | 11/1952 | Doane | 173/328 |
| 2,677,811 | 5/1954 | Anderson et al. | 339/91 |
| 2,918,521 | 12/1959 | Abrams | 174/52 |
| 3,125,395 | 3/1964 | Swanson | 339/176 |
| 3,327,282 | 6/1967 | Krolak | 339/63 |
| 3,398,391 | 8/1968 | Brishka | 339/94 |
| 3,613,048 | 10/1971 | Brundaza | 339/89 |
| 3,644,938 | 2/1972 | Slate | 339/91 |
| 3,671,920 | 6/1972 | Lantorno et al. | 339/59 |
| 3,681,739 | 8/1972 | Kornick | 339/94 |
| 3,719,918 | 3/1973 | Kerr | 339/90 |
| 3,897,131 | 7/1975 | Stauffer | 339/220 |
| 4,084,875 | 4/1978 | Yamamoto | 339/94 |
| 4,150,866 | 4/1979 | Snyder, Jr. et al. | 339/94 |
| 4,214,802 | 7/1980 | Otani et al. | 339/60 |
| 4,420,210 | 12/1983 | Karol et al. | 339/94 |
| 4,445,744 | 5/1984 | Sedig et al. | 339/94 |
| 4,460,227 | 7/1984 | Ball | 339/94 |
| 4,519,662 | 5/1985 | Riley et al. | 339/94 |
| 4,643,506 | 2/1987 | Kobler | 339/94 |
| 4,648,672 | 3/1987 | Kobler | 339/94 |
| 4,671,591 | 6/1987 | Archer | 439/346 |
| 4,753,602 | 6/1988 | Peyrat et al. | 439/246 |
| 4,836,801 | 6/1989 | Ramirez | 439/322 |
| 4,941,847 | 7/1990 | Welsh | 439/595 |
| 5,021,001 | 6/1991 | Ramirez | 439/349 |
| 5,115,563 | 5/1992 | Wilson | 29/876 |
| 5,158,479 | 10/1992 | Mouissie | 439/589 |
| 5,219,185 | 6/1993 | Oddenino | 285/305 |
| 5,266,045 | 11/1993 | Yamamoto et al. | 439/275 |
| 5,299,949 | 4/1994 | Fortin | 439/275 |

FOREIGN PATENT DOCUMENTS

| | | |
|---|---|---|
| 0214617 | 9/1986 | European Pat. Off. . |
| 3725261 | 7/1987 | Germany . |
| 3804107 | 2/1988 | Germany . |
| 1060271 | 2/1964 | United Kingdom . |

*Primary Examiner*—Gary F. Paumen
*Attorney, Agent, or Firm*—Thomas L. Peterson

[57] ABSTRACT

A connector is described which has contacts projecting through passages of an insulator, which provides a reliable fluid-tight seal at each contact. Each insulator passage (36, FIG. 7) has first and second passage portions (51, 52) of different diameters, and each contact has contact portions (56, 57) lying in corresponding passage portions, with each contact portion having an enlargement (41, 42) lying in interference fit with a corresponding passage portion. The different diameters of the passage portions and enlargements, provide a plurality of different seal locations, with each seal location being maximally deformed only by the enlargement which lies in an interference fit therein. A front end of the connector is retained within the rear end of a second connector, by a largely U-shaped spring (100, FIG. 5) whose base (102) can be depressed to move down the opposite legs (104, 106) of the spring. The middle (110) of each leg normally lies rearward of a shoulder (130) on the first connector to prevent the first connector from being pulled rearwardly out of the second one. When the base of the spring is depressed, lower ends (116) of the spring arms are deflected (to 116A) by a cam (120) formed on the second connector housing, which presses the spring legs apart.

1 Claim, 5 Drawing Sheets

FIG. 3
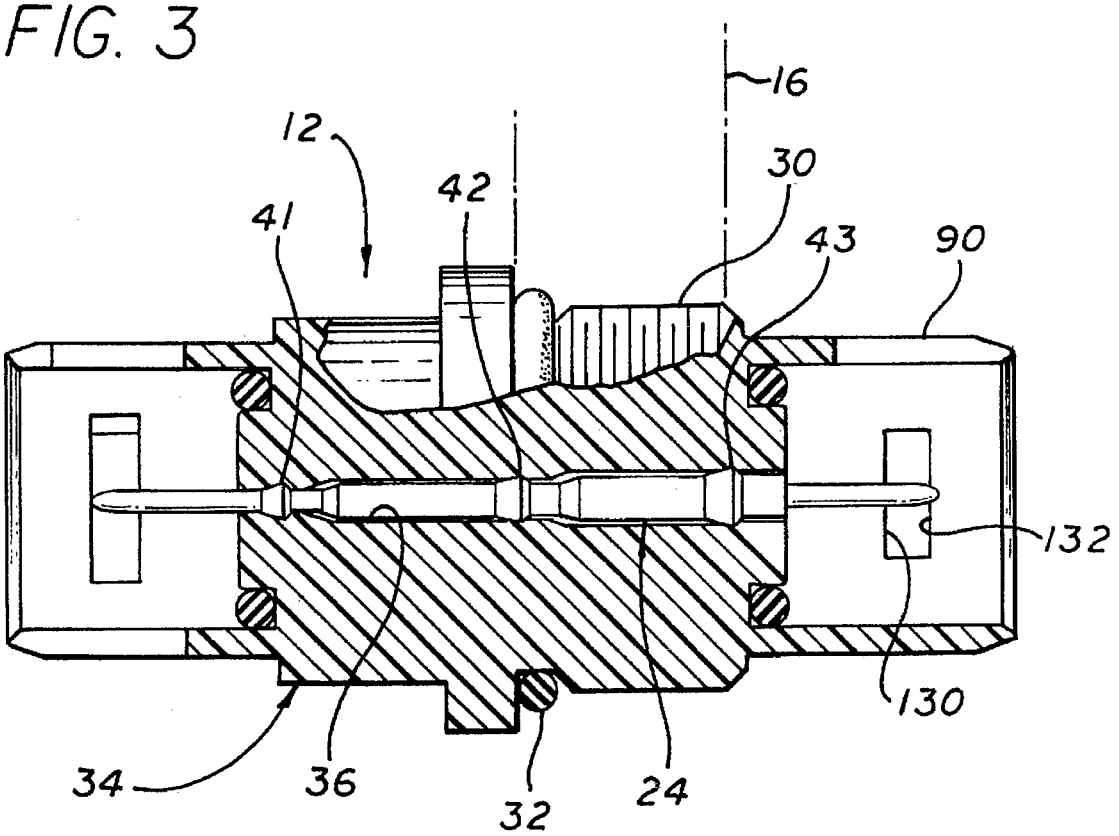
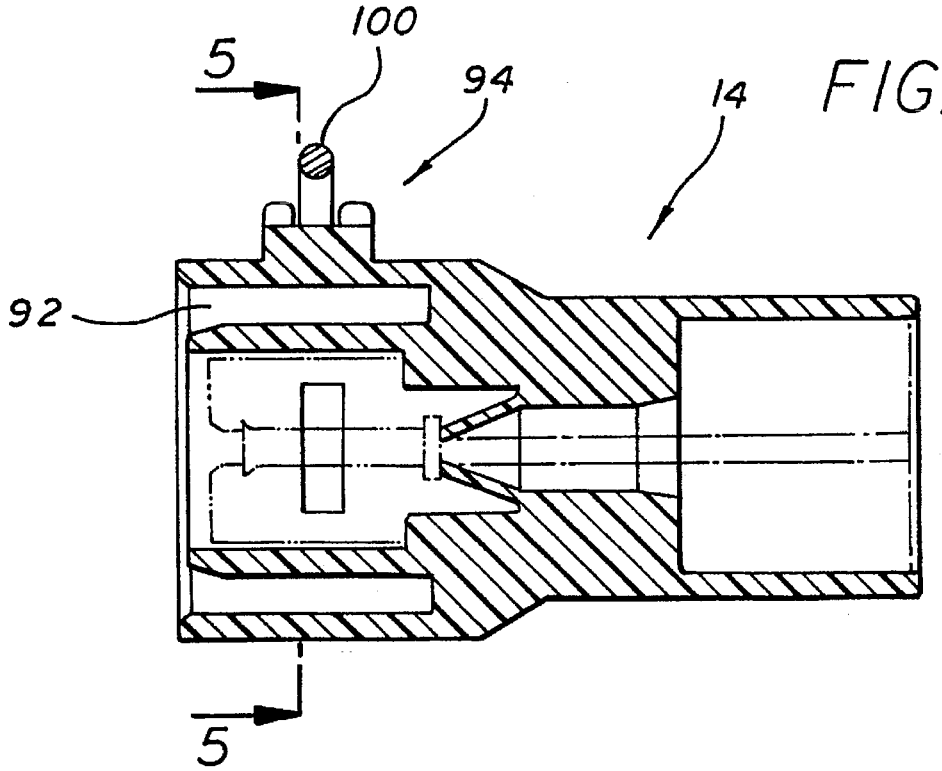
FIG. 4

CONNECTOR LATCH MECHANISM

This is a division of application Ser. No. 08/300,685 filed on Sep. 2, 1994, now U.S. Pat. No. 5,460,549 issued Oct. 24, 1995.

BACKGROUND OF THE INVENTION

Connectors that extend through pressure walls, wherein there is a different pressure on opposite sides of the wall, may require contacts that are tightly sealed to passage walls of the contact insulator. One way to provide a seal, is to form each contact with an enlargement that is of larger outside diameter than the inside diameter of a corresponding location along the insulator passage. The interference fit is intended to provide a fluid-tight seal. However, the seal at a contact enlargement may not be reliable, and it is desirable to provide a plurality of such seals as by providing a plurality of enlargements spaced along the length of the contact, which engage corresponding locations along the passage. However, it is found that even with a plurality of such seals, that fluid may leak through the passage. High reliability is required for connectors having a plurality of contacts, to prevent fluid leakage through any of the contacts.

When a pair of connectors are mated, the rear end of a first connector may be received within the front end of the second connector. It is usually desirable to provide a device that reliably holds the connectors together until they are intended to be unmated. In many applications, it is desirable that the retention device be of simple and low cost construction, and be very easily releasable, as by merely depressing a member.

SUMMARY OF THE INVENTION

In accordance with one embodiment of the present invention, a connector and connector system are provided, wherein the contacts of a first connector are reliably sealed to the insulator thereof. A plurality of fluid-tight seals are established between enlargements on contact portions of a first contact and passage portions of a first passage, by interference fit of the enlargements with the corresponding passage portions. A plurality of passage portions are of different inside diameters, and a plurality of contact enlargements are of different outside diameters. A rearmost enlargement, which first moves through the passage during installation, has a smaller outside diameter than a second enlargement, to avoid or minimize deformation of the second passage portion prior to the second enlargement fitting therein.

The contacts are inserted into the insulator passages by thrusting them into place, at a velocity of more than five inches per second. The insulator is formed of a polymer having a high tensile strength and high ultimate elongation, such as Nylon, so that the walls of the passage are largely resiliently deflected by the contact enlargement thrust into place therein.

A latching mechanism includes a spring mounted on the second connector to slide largely vertically thereon. The spring has an upper part that can be depressed, a middle that lies rearward of a shoulder on the first connector to prevent its withdrawal, and a lower part that lies against a cam on the second connector housing. When the spring upper part is depressed, the spring lower part is deflected outwardly to move the spring middle largely out of line with the shoulder on the first connector. This allows withdrawal of the first connector.

The novel features of the invention are set forth with particularity in the appended claims. The invention will be best understood from the following description when read in conjunction with the accompanying drawings.

BRIEF DESCRIPTION OF THE DRAWINGS

FIG. 3 is a primarily sectional side view of the first connector of FIG. 2.

FIG. 4 is a sectional view of the second connector of FIG. 2, and with a connector insert shown only in phantom lines and with a slot of the first connector also shown in phantom lines.

DESCRIPTION OF THE PREFERRED EMBODIMENTS

Figure 1:
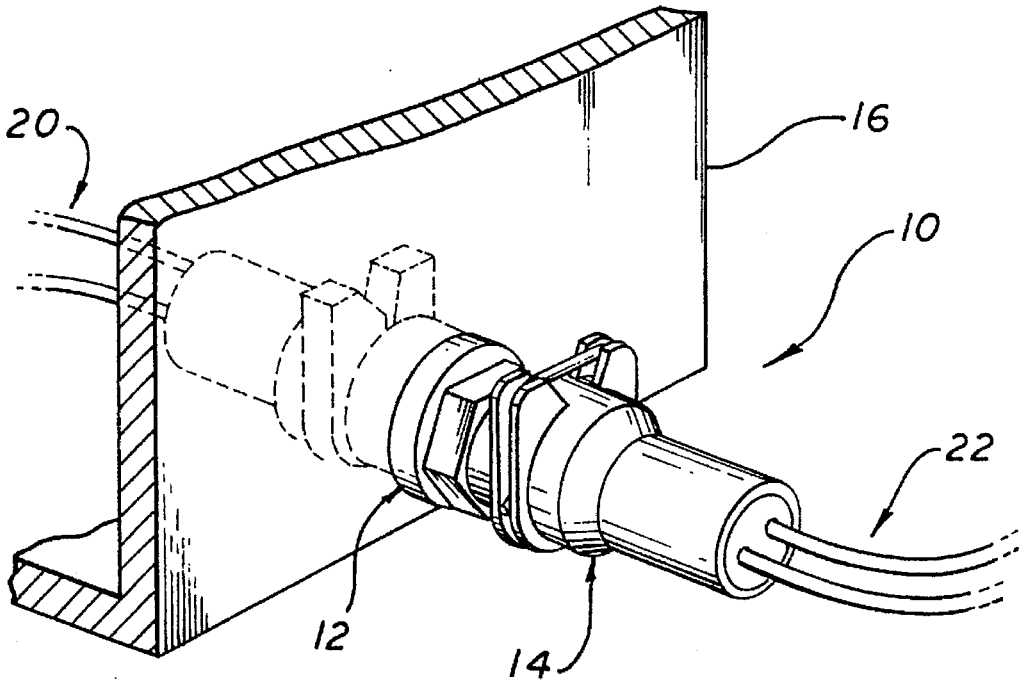
FIG. 1 is an isometric view of a connector system constructed in accordance with one embodiment of the present invention, showing the first connector installed on a pressure tight wall and showing the second connector mated with the first one.
Figure 2:
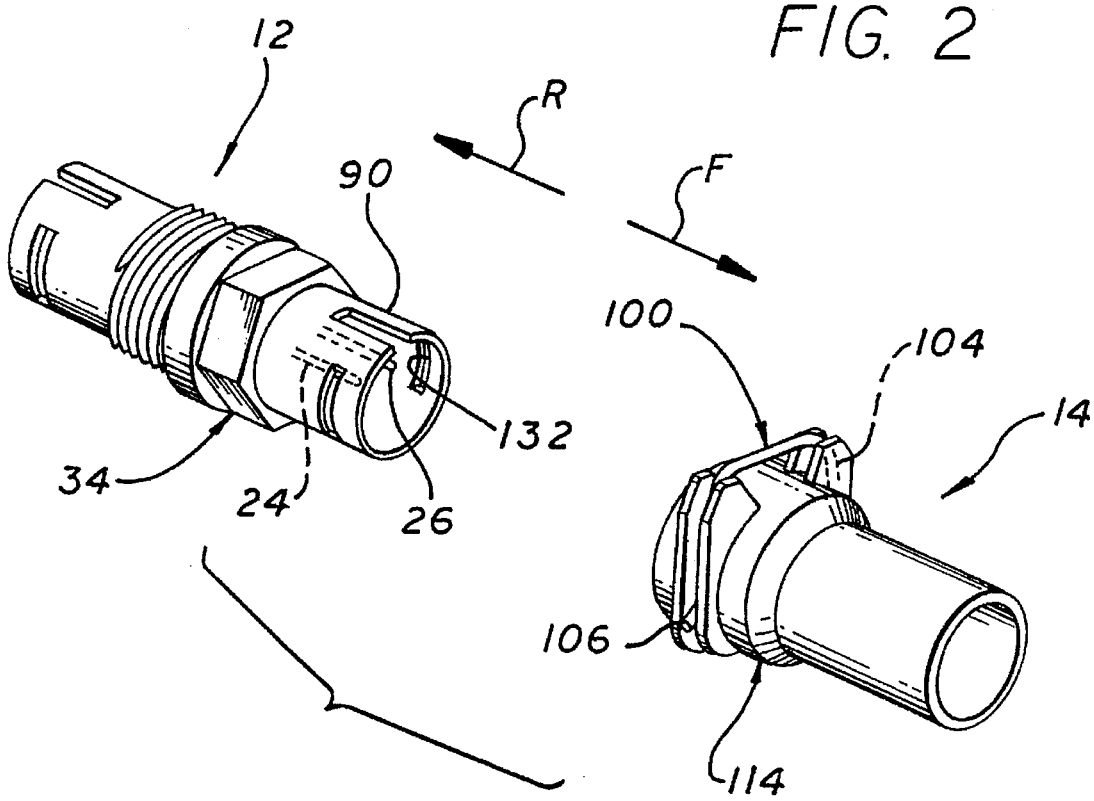
FIG. 2 is an isometric view of the connector system of FIG. 1, with the first and second connectors separated.

FIG. 1 illustrates a connector system 10 which includes first and second connectors 12, 14 that are shown mated. The first connector 12 is mounted on and passes through a pressure-tight wall 16. In one application, the wall 16 is a wall of a vehicle transmission that holds transmission fluid at a pressure such as 5 psi. The connector is used to transmit sensor signals through the wall, between pairs of wires 20, 22 lying on opposite sides of the wall. As shown in FIG. 2, the first connector has a pair of contacts 24, 26 which carry currents through the pressure-tight wall.

FIG. 3 shows the first connector 12, that has a threaded part 30 threadably installed in the pressure-tight wall 16, and that has an O-ring seal 32 sealing the periphery of the connector to the wall. The connector has an insulator 34 with contact receiving passages such as passage 36 which receives contact 24. The contact has three enlargements 41, 42, 43 that lie in interference fit with potions of the passage 36 to provide a fluid-tight seal that prevents any pressured fluid that reaches the rear of the contact passage, from flowing to the front thereof.

Figure 7:
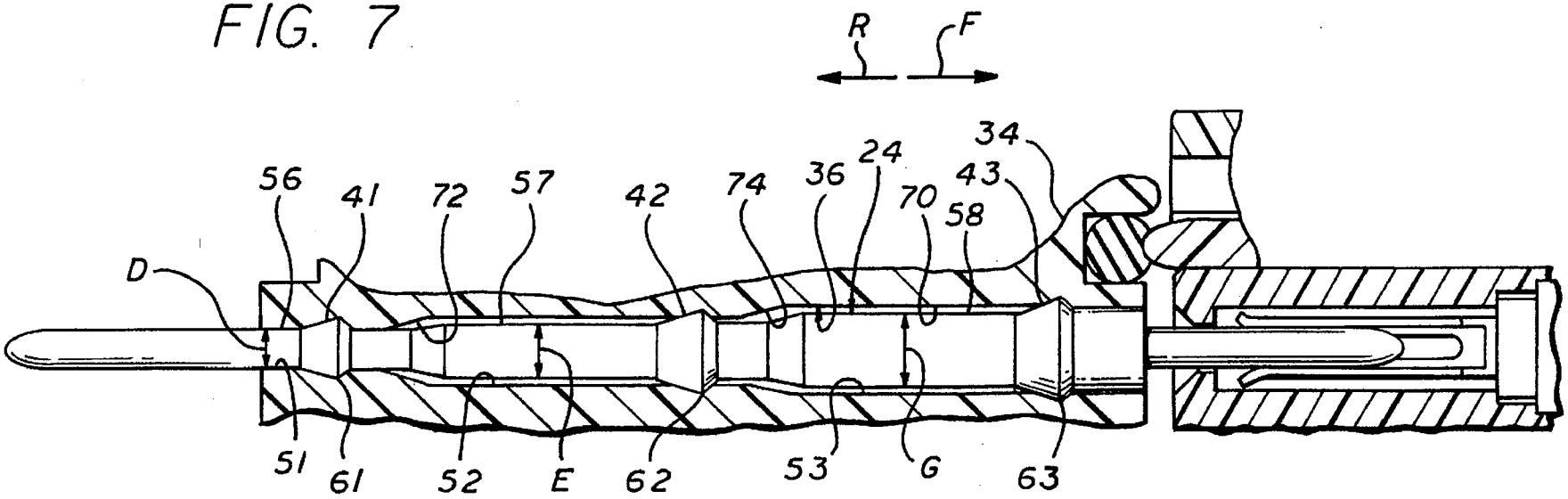
FIG. 7 is an enlarged sectional view of a portion of the connector of FIG. 3, showing a contact thereof mated to a contact of a second connector.

As shown in FIG. 7, the insulator passage 36 has a plurality of passage portions 51, 52, and 53 that are spaced along the length of the passage. The enlargements 41–43 are of different diameters, with the more forward ones (in direction F) being of progressively greater outside diameter. The passage portions 51–53 are also of different diameters with the more forward ones being of progressively greater diameters. Each enlargement has a location 61–63 of greatest outside diameter, where the enlargement lies in interference fit with a corresponding passage portion 51–53. The enlargements lie on contact portions 56, 57, 58 that are preferably not in interference fit with the walls of the passage.

Figure 8:
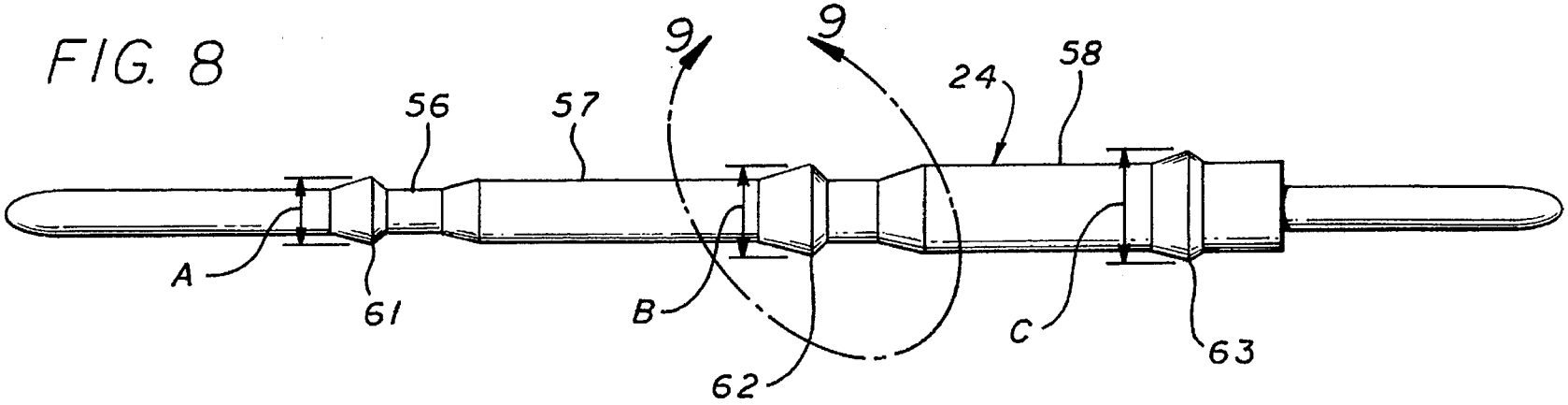
FIG. 8 is a side elevation view of the first connector contact of FIG. 7.

The different sizes of the enlargement locations 61–63 and of the corresponding passage portions 51–53 in which they lie, has the advantage of avoiding or minimizing damage to the passage portions during insertion of the contact into the insulator. The contact is installed by moving it in the rearward direction R through the passage until it reaches the position shown in FIG. 7. The first enlargement location 61 has an outside diameter A (FIG. 8) which is preferably smaller than, or at least only slightly greater than, the inside diameters E, G (FIG. 7) of the second and third passage portions 52, 53 that lie forward of the first passage portion 51. As a result, when the first enlargement 61 moves rearwardly through the passage portions 52, 53 during insertion of the contact, the first location 61 will not press (or press with much force) against the second and third passage portions 52, 53, thereby avoiding damage to them. Similarly, the second enlargement location 62 has an outside diameter B which is preferably smaller (or only slightly greater) than the inside diameter G of the third passage portion 53, to avoid damage to it during contact insertion. The only time when the walls 70 of the passage portions are deflected, is when an enlargement that will remain in that passage portion, is pushed into place therein. By avoiding two traumas or deflections of the passage wall portions, applicant minimizes the possibility of permanent damage that would avoid a fluid tight seal of each enlargement with a corresponding passage portion. In some instances, a location on the passage walls will remain intact when first deflected, but not when deflected, released, and again deflected by large amounts.

Figure 9:
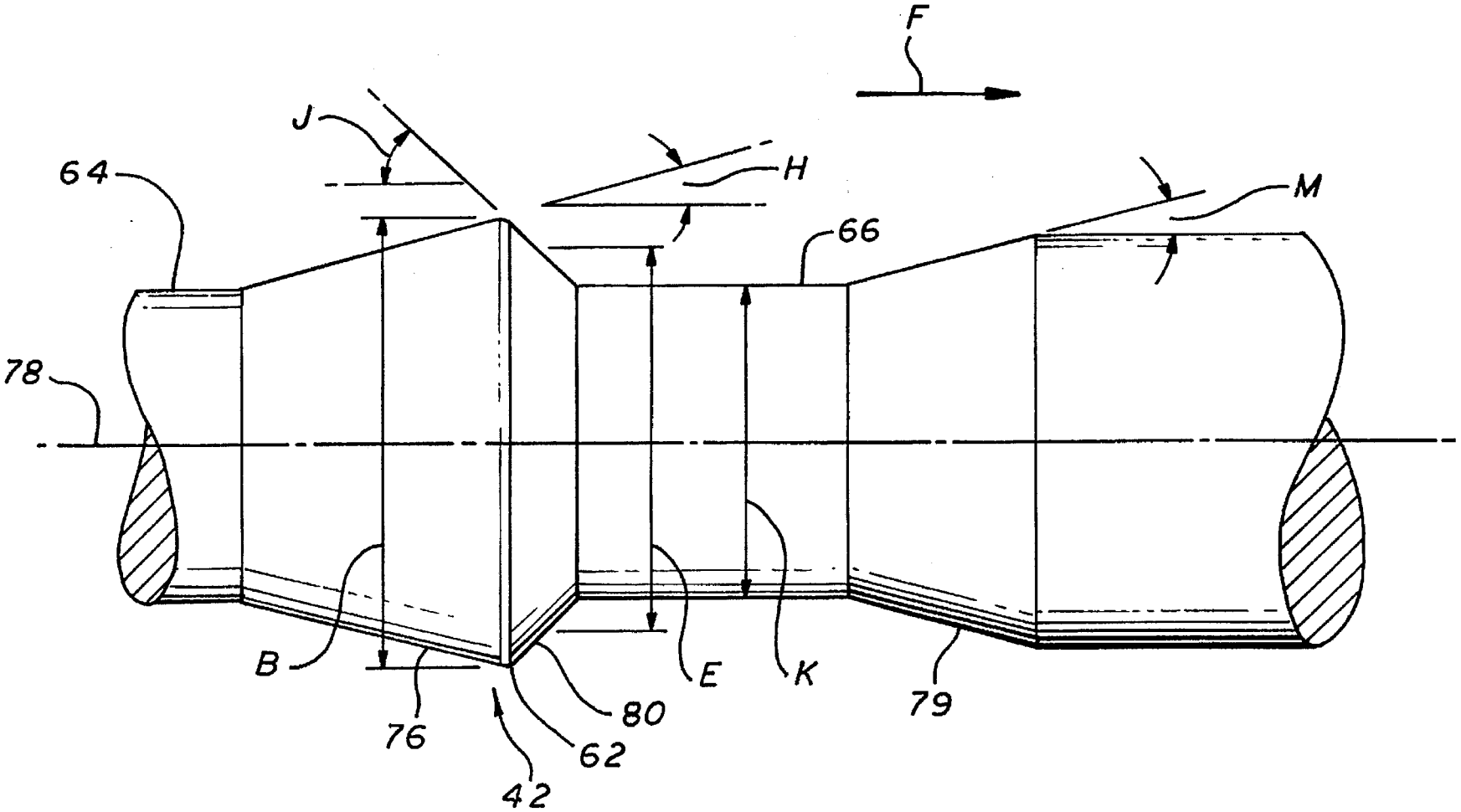
FIG. 9 is an enlarged view of the area 9—9 of FIG. 8.

To help avoid damage to the passage walls, applicant provides transition passage parts 72, 74 at the front ends of the first and second passage portions 51, 52. Such transition passage parts cause each enlargement to gradually expand the corresponding passage portion, to encourage resilient deflection of the insulative material while avoiding scraping or other damage to it. To this end, each enlargement has a construction such as shown in FIG. 9 for enlargement 42, with a rear part 76 that is tapered at a relatively small angle H with respect to the contact axis 78. The particular angle H which is shown is 15°, and applicant prefers that this angle be no more than 20°. The transition passage parts and transition contact parts are preferably similarly angled, with angle M for contact transition part 79 preferably being less than 30° and actually being 15°.

Each enlargement has a front part 80 which is tapered at a large angle J with respect to the contact axis 78. The taper angle J is preferably not more than 60°, and more preferably about 45°. It would instead, be possible to make the angle J 90°, so that the front part of the enlargement faced directly forward. However, by providing an angle J of less than 60° at the front part, applicant provides a progressive deformation of the material of the insulator. The alternative of a 90° angle would result in the insulator material experiencing maximum stress at the location 62, and not being stressed immediately forward thereof. Such a sudden change in stress and strain is more likely to cause break away of material immediately forward of the location 62. The large angle J is large enough that, if the contact is pushed hard in the forward direction F, that friction between the surface of the front part 80 and the facewise adjacent portion of the insulator material, will not result in sliding, and the resistance will be about as great as for an angle J of 90° in the absence of damage to the insulator at 80.

The particular contact 24 has a length of one and one-haft inch. The insertion of such interfering contacts into insulators can be performed on an arbor press. In such a press, the insulators of a group of contacts are mounted on a fixture on the lower part of the press, and the contacts are mounted on another fixture at the upper end of the press. A worker moves down a handle, which causes an upper press part to move down and press the contacts into place. The worker may move down the handle during a period of perhaps 0.5 second to 2 seconds and then release it. As a result, each contact is pushed into place at a speed of about 0.75 inch per second to 3 inches per second.

Applicant finds that if he rapidly thrusts the contacts into place in the insulator, that this results in less harm to the insulator material, resulting in a more reliable seal between the enlargements and the passage portions. Applicant prefers that the contacts be inserted at a velocity of more than five inches per second, and more preferably at a velocity of at least ten inches per second. It appears that when the plastic material of the insulator is very rapidly deflected, that it is more likely to be elastically deflected rather than being scraped or plastically deformed (wherein it does not return entirely to its initial size). Applicant also finds that a more reliable fluid type seal between each enlargement and a corresponding passage portion, is obtained by using an insulator material of high tensile strength and high elongation. Applicant prefers to use Nylon which has a tensile strength of more than 9,000 psi and a maximum elongation of over 3%. It is noted that in general, Nylon has a tensile strength of 9,000 to 12,000 psi, with glass filled Nylon (Nylon alloy) having a strength of 21,000 psi and elongation of 3.3%. The large elongation permits large resilient deflection of the material, resulting in its springing back to its original size, when an enlargement passes by.

Applicant has constructed connectors with contacts and insulators of the construction such as shown in FIGS. 1–8. Each contact has an overall length of 1.46 inch. The enlargement locations 61, 62, 63 have diameters A, B, and C, of 0.062 inch, 0.085 inch, and 0.104 inch, respectively with each of these dimensions being held to a tolerance of plus or minus 2 mils (one mil equals one thousandth inch). The passage portions have initial inside diameters D, E, F of 0.046, 0.069, and 0.088, with each dimension being to a tolerance of plus or minus two mils. Thus, the nominal interference between each enlargement location 61–63 and each corresponding passage portion 51–53 is 16 mils. The second contact portion 57 has a diameter K of 0.055 inch, at regions 64, 65 that lie rearward and forward of the enlargement 42. The other contact portions 56 and 58 have diameters of 0.040 inch and 0.083 inch, respectively. The contact was formed of nickel-plated brass. Applicant installed the contacts in the insulator by thrusting them into place, at a velocity of about 12 inches per second. Although each connector was to be used to withstand a fluid pressure difference of 5 psi, standards required pressure testing at a pressure difference of 50 psi, and no leakage was found in the tested connectors. The presence of three redundant sealing locations, at the three enlargements, makes the possibility of leakage much less than if a single sealed location were used.

Figure 5:
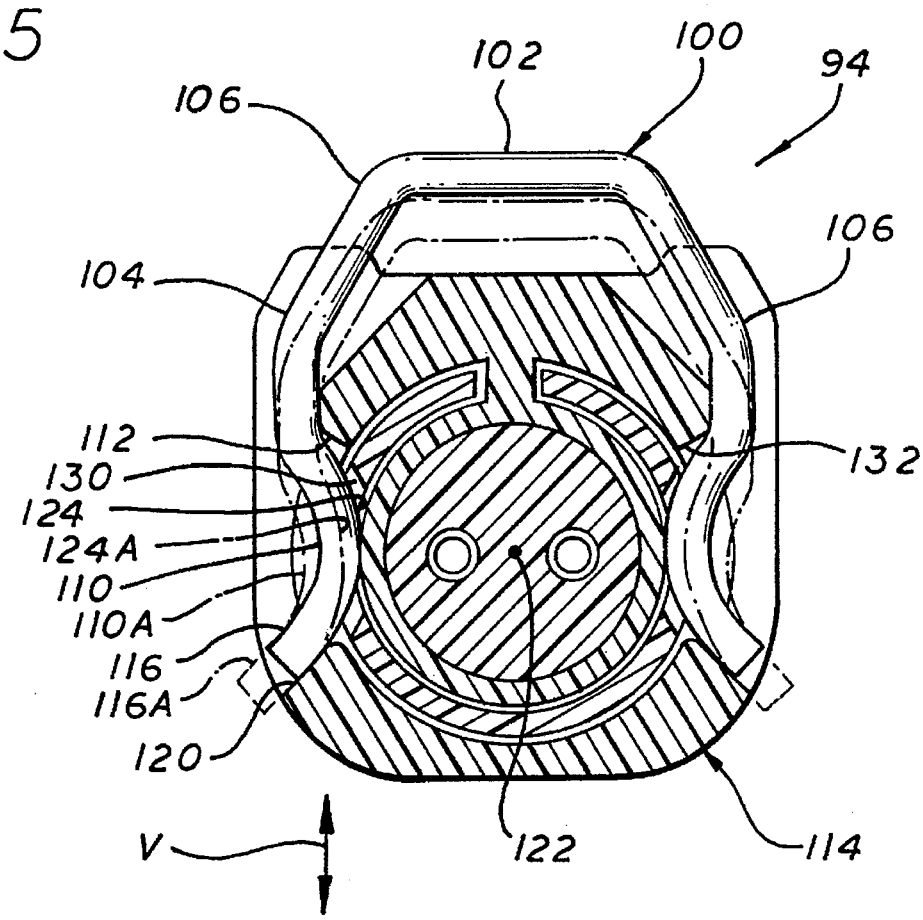
FIG. 5 is a view taken on line 5—5 of FIG. 4, and also showing the connector insert and showing the first connector mated to the second one.
Figure 6:
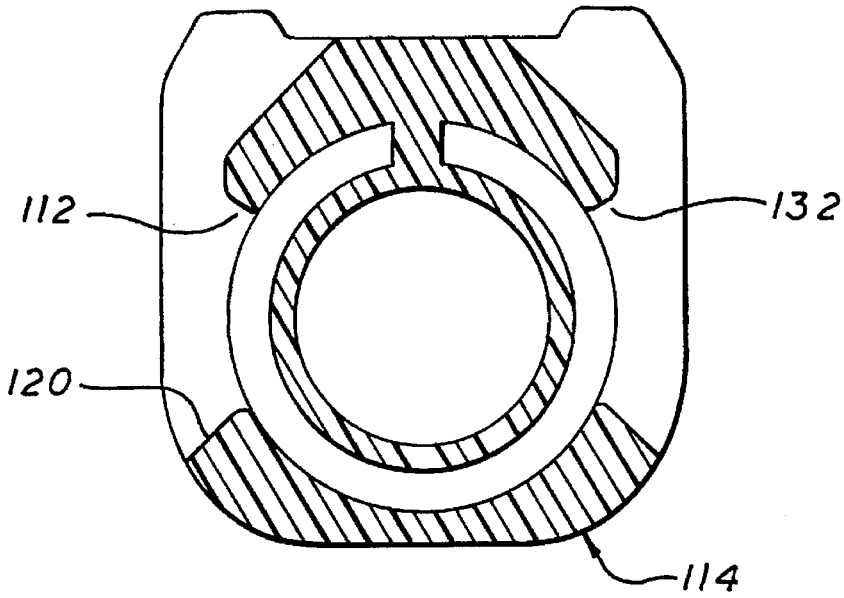
FIG. 6 is a view similar to that of FIG. 5, but showing only the second connector insulator, without the connector insert therein.

When the first connector 12 of FIG. 3 is mated to the second connector 14 of FIG. 4, the front end 90 of the first connector is received in a cavity 92 of the second one. The front end 90 of the first connector is substantially in the form of a cylindrical sleeve, as is clearly shown in FIG. 2. The cavity 92 of the second connector has substantially cylindrical inner cavity walls, as is shown in FIGS. 4–6. Applicant provides a low cost and simple latching mechanism 94 to keep the inserted end 90 of the first connector within the cavity 92 of the second one. As shown in FIG. 5, the latching mechanism 94 includes a spring 100 which is of largely U-shape, with a portion 102 forming the base of the U-shape and with opposite sides 104, 106 forming the arms of the U. The spring can be depressed by pressing down the upper portion 102 to move the sides 104, 106 largely downward along the vertical direction V. Each side such as 104 has an upper part 106 that can be depressed, a middle 110 which projects into a slot 112 of the second connector housing 114, and a lower part 116. The second connector housing 114 has a camming wall 120 which engages the lower part 116. When the spring lower part 116 moves down, the camming wall 120 presses it outwardly, at least partially away from the axis 122 of the second connector, to the position 116A. As a result, the inner surface 124 of the spring side middle 110 moves from the position 124 to the deflected position 124A. In the undeflected position at 124, the middle lies in the way of a forwardly-facing shoulder 130 of the forward end of the first connector, which prevents rearward withdrawal of the first connector from the second one. However, when the middle has been deflected to the position 110A, the middle is largely out of line with the shoulder 130, so that the shoulder can move rearwardly and the first connector can be moved out of the second one.

It may be noted that the spring 100 is formed of round wire, so even if the deflected spring middle 110A is not entirely out of the way of the shoulder 130, rearward force on the first connector and on the shoulder 130 can cause it to deflect the middle at 110A out of the way. Formation of slots 112, 132 in the second connector housing does not add much to its cost. The spring 100 can be constructed at low cost, and can be installed by merely pressing it into place. As shown in FIG. 3, the shoulder 130 is a wall of a slot 132. Thus, the latching mechanism can be constructed at very low cost, and yet can be quickly operated to unmate the connectors.

Thus, the invention provides a connector system wherein a first connector has contacts forming reliable fluid-tight seals with the walls of the insulator passages, and also provides a low cost and easily operated latching mechanism that holds a pair of mated connectors together. A contact of the first connector has enlargements spaced along its length, with locations of maximum diameter having different diameters. Portions of the insulator passage in which the enlargements ultimately lie, have different inside diameters. This allows the smaller diameter enlargement(s) to pass through the larger inside diameter passage portion(s) during installation, while avoiding or minimizing deflection of the larger passage portions. Where the contacts and/or passages are not of round shape as viewed along the contact axis, the width of the enlargement or passage portion can be considered to be its diameter. The contacts are preferably rapidly thrust into place, and the insulator is preferably of a material of high tensile strength and high ultimate elongation such as Nylon. A latching mechanism for holding a pair of contacts in mating engagement with each other, includes a spring in the form of a wire with an upper part that can be depressed. The spring has a lower part that is deflected sidewardly away from the connector axis, by a camming portion of the connector housing. The spring has a middle that normally blocks a shoulder of the first connector from withdrawal from the second oné, until the lower spring part is deflected.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector system which includes a first connector that has a first housing with a front end that is substantially in the form of a hollow cylindrical sleeve, and a second connector that has a second housing with an axis and with a rear end, said rear end of said second housing having cavity walls forming a cavity with substantially cylindrical inner cavity walls which receives said first connector housing front end when said connectors are mated, said connectors having contacts constructed to mate when said connectors mate, wherein:

said second connector includes a largely U-shaped spring having a top forming a largely horizontally-extending base with opposite ends, and having a pair of legs each extending generally downwardly from one of said ends of said base, said spring being largely vertically shiftable on said second housing by depressing said base;

said cylindrical sleeve has a pair of through slots that are each positioned to receive a leg part of a corresponding one of said legs when said connectors mate, with said slots each forming a largely rearwardly-facing shoulder that lies directly forward of the corresponding one of said leg parts;

said second housing forms a pair of cams that engage said legs and that deflect said legs apart to move said leg parts largely out of said slots when said spring is depressed.

* * * * *